US011399638B2

(12) United States Patent
Cummings

(10) Patent No.: US 11,399,638 B2
(45) Date of Patent: Aug. 2, 2022

(54) MULTIFUNCTIONAL INFANT CARRIER

(71) Applicant: Kimberly Cummings, Newnan, GA (US)

(72) Inventor: Kimberly Cummings, Newnan, GA (US)

( * ) Notice: Subject to any disclaimer, the term of this patent is extended or adjusted under 35 U.S.C. 154(b) by 0 days.

(21) Appl. No.: 16/623,312

(22) PCT Filed: Oct. 16, 2017

(86) PCT No.: PCT/US2017/056794
§ 371 (c)(1),
(2) Date: Dec. 16, 2019

(87) PCT Pub. No.: WO2018/236412
PCT Pub. Date: Dec. 27, 2018

(65) Prior Publication Data

US 2020/0229615 A1 Jul. 23, 2020

Related U.S. Application Data

(60) Provisional application No. 62/524,264, filed on Jun. 23, 2017.

(51) Int. Cl.

| | |
|---|---|
| ***A47D 15/02*** | (2006.01) |
| ***A47D 13/02*** | (2006.01) |
| ***A45F 3/14*** | (2006.01) |
| ***A47D 15/00*** | (2006.01) |

(52) U.S. Cl.
CPC ..... *A47D 13/02* (2013.01); *A45F 3/14* (2013.01); *A47D 15/005* (2013.01)

(58) Field of Classification Search
CPC ..... A47D 13/02; A47D 13/025; A47D 15/005
USPC ..... 224/158–160
See application file for complete search history.

(56) References Cited

U.S. PATENT DOCUMENTS

| | | | | |
|---|---|---|---|---|
| 4,149,687 A * | 4/1979 | Nunemacher | ..... | A47D 13/025 224/159 |
| 4,428,514 A * | 1/1984 | Elf | ..... | A47D 13/025 224/155 |
| 4,724,988 A | 2/1988 | Tucker | | |
| 5,156,436 A | 10/1992 | Grene | | |
| 5,178,309 A | 1/1993 | Bicheler et al. | | |

(Continued)

FOREIGN PATENT DOCUMENTS

| | | |
|---|---|---|
| CN | 102764002 A | 11/2012 |
| GB | 2512085 | 5/2013 |

(Continued)

OTHER PUBLICATIONS

Elastics/Cords, created on Jul. 8, 2009. Accessed from https://web.archive/org/web/20160513003856/http://milspecmonkey.com/customize/elasticscord.

(Continued)

*Primary Examiner* — Adam J Waggenspack
(74) *Attorney, Agent, or Firm* — Ballard Spahr LLP

(57) ABSTRACT

This invention relates to an infant carrier adaptable for selectively carrying the infant in the front or the back of the wearer and facing towards or away from the wearer without requiring that the child be repositioned in the carrier. This abstract is intended as a scanning tool for purposes of searching in the particular art and is not intended to be limiting of the present invention.

21 Claims, 12 Drawing Sheets

(56) References Cited

U.S. PATENT DOCUMENTS

| | | | | |
|---|---|---|---|---|
| 5,205,451 | A * | 4/1993 | Manzer | A47D 13/025 224/161 |
| 5,330,250 | A | 7/1994 | Reyes | |
| 5,625,895 | A | 5/1997 | Sovereign | |
| 5,678,739 | A * | 10/1997 | Darling | A47D 13/025 224/158 |
| 5,829,835 | A | 11/1998 | Rogers et al. | |
| 6,257,468 | B1 * | 7/2001 | Yamazoe | A47D 13/02 224/158 |
| 6,415,969 | B1 * | 7/2002 | Higuchi | A47D 13/025 224/160 |
| 6,598,771 | B2 * | 7/2003 | Norman | A47D 13/025 224/160 |
| 6,666,361 | B1 * | 12/2003 | Lin | A45F 3/02 224/160 |
| 6,763,983 | B2 * | 7/2004 | Norman | A47D 13/025 224/160 |
| 6,988,644 | B1 * | 1/2006 | Asherbranner | A47D 13/025 224/160 |
| 7,770,765 | B2 * | 8/2010 | Stevens | A47D 13/025 224/160 |
| 7,926,881 | B1 | 4/2011 | Youreman | |
| 8,028,871 | B2 * | 10/2011 | Gray | A47D 13/025 224/160 |
| 8,042,869 | B2 | 10/2011 | McClintock et al. | |
| 8,550,316 | B2 * | 10/2013 | Coote | A47D 15/006 224/160 |
| 9,220,352 | B2 | 12/2015 | Frost | |
| 9,480,344 | B1 | 11/2016 | Vialpando et al. | |
| 10,028,592 | B1 | 7/2018 | Ruiz | |
| 2003/0192925 | A1 | 10/2003 | Boone | |
| 2005/0155996 | A1 | 7/2005 | Hiscocks | |
| 2005/0258202 | A1 | 11/2005 | Stevens et al. | |
| 2006/0011678 | A1 * | 1/2006 | Kassai | A47D 13/025 224/160 |
| 2006/0261104 | A1 * | 11/2006 | Zambrzycki | A47D 13/025 224/158 |
| 2007/0057002 | A1 | 3/2007 | Timm et al. | |
| 2008/0313812 | A1 * | 12/2008 | Reeves | B60N 2/2845 5/655 |
| 2009/0026235 | A1 | 1/2009 | Gray | |
| 2011/0240693 | A1 | 10/2011 | Parness et al. | |
| 2014/0252814 | A1 | 9/2014 | Cohen et al. | |
| 2014/0296045 | A1 * | 10/2014 | Krstanoski-Blazeski | A47D 13/025 482/139 |
| 2015/0035331 | A1 | 2/2015 | Sparling | |
| 2015/0374139 | A1 | 12/2015 | Salazar et al. | |
| 2017/0303667 | A1 | 4/2017 | Lopez | |
| 2018/0235379 | A1 | 8/2018 | Lindeman et al. | |

FOREIGN PATENT DOCUMENTS

| | | | |
|---|---|---|---|
| WO | WO-2017/117493 | A1 | 7/2017 |
| WO | WO-2018/236412 | A1 | 12/2018 |

OTHER PUBLICATIONS

Response to Non-Final Office Action filed on Feb. 18, 2020 with the USPTO for U.S. Appl. No. 16/067,062, filed Jun. 28, 2018 and published as US 2019/0014921 A1 on Jan. 17, 2019 (Inventor—Kimberly Cummings) (10 Pages).

Final Office Action dated May 19, 2020 by the USPTO for U.S. Appl. No. 16/067,062, filed Jun. 28, 2018 and published as US 2019/0014921 A1 on Jan. 17, 2019 (Inventor—Kimberly Cummings) (6 Pages).

Response to Final Office Action filed on Jul. 17, 2020 with the USPTO for U.S. Appl. No. 16/067,062, filed Jun. 28, 2018 and published as US 2019/0014921 A1 on Jan. 17, 2019 (Inventor—Kimberly Cummings) (19 Pages).

Response to Final Office Action filed on Apr. 30, 2020 with the USPTO for U.S. Appl. No. 16/019,262, filed Jun. 26, 2018 and published as US 2019/0038044 A1 on Feb. 7, 2019 (Inventor—Kimberly Cummings) (14 Pages).

Non-final Office Action dated May 22, 2020 by the USPTO for U.S. Appl. No. 16/019,262, filed Jun. 26, 2018 and published as US 2019/0038044 A1 on Feb. 7, 2019 (Inventor—Kimberly Cummings) (14 Pages).

Response to Non-Final Office Action filed on Jul. 17, 2020 with the USPTO for U.S. Appl. No. 16/019,262, filed Jun. 26, 2018 and published as US 2019/0038044 A1 on Feb. 7, 2019 (Inventor—Kimberly Cummings) (16 Pages).

Non-Final Office Action dated Sep. 29, 2020 with the USPTO for U.S. Appl. No. 16/067,062, filed Jun. 28, 2018 and published as US 2019/0014921 A1 on Jan. 17, 2019 (Inventor—Kimberly Cummings) (9 Pages).

Final Rejection dated Feb. 7, 2020 by the USPTO for U.S. Appl. No. 16/019,262, filed Jun. 26, 2018 and published as US 2019/0038044 Al on Feb. 7, 2019 (Inventor—Kimberly Cummings) (11 Pages).

Final Office Action dated Aug. 10, 2020 with the USPTO for U.S. Appl. No. 16/019,262, filed Jun. 26, 2018 and published as US 2019/0038044 A1 on Feb. 7, 2019 (Inventor—Kimberly Cummings) (14 Pages).

Non-Final Office Action dated Feb. 24, 2021 with the USPTO for U.S. Appl. No. 16/019,262, filed Jun. 26, 2018 and published as US 2019/0038044 A1 on Feb. 7, 2019 (Inventor—Kimberly Cummings) (17 Pages).

International Search Report and Written Opinion dated Mar. 13, 2017 by the International Searching Authority for International Application No. PCT/US2016/069397, filed on Dec. 30, 2016 and published as WO 2017/117493 on Jul. 6, 2017 (Applicant—Kimberly Cummings) (8 Pages).

International Preliminary Report on Patentability dated Jul. 3, 2018 by the International Searching Authority for International Application No. PCT/US2016/069397, filed on Dec. 30, 2016 and published as WO 2017/117493 on Jul. 6, 2017 (Applicant—Kimberly Cummings) (7 Pages).

Non Final Rejection dated Oct. 29, 2019 by the USPTO for U.S. Appl. No. 16/067,062, filed Jun. 28, 2018 and published as US 2019/0014921 A1 on Jan. 17, 2019 (Inventor—Kimberly Cummings) (8 Pages).

International Search Report and Written Opinion dated Jan. 5, 2018 by the International Searching Authority for International Application No. PCT/US2017/056794, filed on Oct. 16, 2017 and published as WO 2018/236412 on Dec. 27, 2018 (Applicant—Kimberly Cummings) (10 Pages).

International Preliminary Report on Patentability dated Dec. 24, 2019 by the International Searching Authority for International Application No. PCT/US2017/056794, filed on Oct. 16, 2017 and published as WO 2018/236412 on Dec. 27, 2018 (Applicant—Kimberly Cummings) (9 Pages).

Non Final Rejection dated Jun. 10, 2019 by the USPTO for U.S. Appl. No. 16/019,262, filed Jun. 26, 2018 and published as US 2019/0038044 A1 on Feb. 7, 2019 (Inventor—Kimberly Cummings) (13 Pages).

Response to Non Final Rejection dated Sep. 9, 2019 to the USPTO for U.S. Appl. No. 16/019,262, filed Jun. 26, 2018 and published as US 2019/0038044 A1 on Feb. 7, 2019 (Inventor—Kimberly Cummings) (12 Pages).

Non Final Rejection dated Oct. 16, 2019 by the USPTO for U.S. Appl. No. 16/019,262, filed Jun. 26, 2018 and published as US 2019/0038044 A1 on Feb. 7, 2019 (Inventor—Kimberly Cummings) (20 Pages).

U.S. Appl. No. 62/273,938, filed Dec. 31, 2015, Kimberly Cummings.

U.S. Appl. No. 62/409,183, filed Oct. 17, 2016, Kimberly Cummings.

U.S. Appl. No. 16/067,062, filed Dec. 30, 2016, Kimberly Cummings.

U.S. Appl. No. 62/524,264, filed Jun. 23, 2017, Kimberly Cummings.

U.S. Appl. No. 62/525,046, filed Jun. 26, 2017, Kimberly Cummings.

U.S. Appl. No. 16/019,262, filed Jun. 26, 2018, Kimberly Cummings.

(56) References Cited

OTHER PUBLICATIONS

PCT, PCT/US2016/069397 (WO 2017/117493), Dec. 30, 2016 (Jul. 6, 2017), Kimberly Cummings.
PCT, PCT/US2017/056794 (WO 2018/236412), Oct. 16, 2017 (Dec. 27, 2018), Kimberly Cummings.

* cited by examiner

MULTIFUNCTIONAL INFANT CARRIER

CROSS-REFERENCE TO RELATED APPLICATIONS

This Application is a U.S. National Phase Application of International Patent Application No. PCT/US2017/056794, filed on Oct. 16, 2017, which claims priority to U.S. Provisional Application No. 62/524,264, filed on Jun. 23, 2017, the contents of which are incorporated herein by reference in their entireties.

BACKGROUND

Historically, the practice of carrying infants and toddlers on the body of the caregiver was more prevalent in traditional cultures, and indeed, most basic slings and wraps are derivations of long-established designs originating therefrom. In industrialized cultures, it was previously deemed detrimental to the development of the child to experience too much physical contact with caregiver. However, these views are increasingly being challenged on the basis that there are numerous developmental benefits to the child. Additionally, there are immediate benefits to the caregiver such as, for example, the freedom to use both hands while carrying the child. Thus, care may be provided to other children simultaneously, strain and fatigue on the arms, back, and shoulders may be reduced, and household chores may be completed all while simultaneously holding the child. Moreover, cumbersome and bulky strollers need not be deployed in potentially dangerous places such as crowded city sidewalks and public transportation systems. Therefore, on-the-body carrying of children is steadily growing in popularity.

There are a number of configurations for infant carriers suitable for on-the-body carry including slings, wraps, and shoulder-strap carriers. Though simpler in construction, slings and wraps are not as popular as carriers that incorporate shoulder straps, due in part to the difficulty associated with proper wear. Among shoulder-strap carriers, there are frame-type carriers that support the infant on the back of the wearer, frameless or soft-sided carriers that support the infant on the front or chest of the wearer, as well as those that support the child on the hip of the wearer.

As exemplified above, there are a number of positions and orientations in which the child may be carried, each being appropriate for different circumstances. For example, when the child is sleeping or may be agitated due to increased stimulation, the child may be carried on the front of and facing towards the caregiver. Further, while on the go, completing errands, or otherwise participating in activity that takes the child out of the home, a greater degree of interaction with the surrounding environment may be offered by carrying the child in the front of and facing outward from the caregiver. However, as the body of the caregive does not shield the child when worn in the front, it may be appropriate in certain circumstances to carry the child on the back.

Unfortunately, existing infant carriers fail to adequately account for the interchangeability of carrying the child in the front as well as the back in a desired orientation (i.e., facing in or facing out). In each instance, the harness must be unfastened and the child re-positioned. Thus, a sleeping child will instantly awaken, and a caregiver's "free hands" will quickly become overfull as they attempt to juggle the child, the harness, a diaper bag, an older child, or any other number of variables.

Additionally, wearing a child in the same position for extended periods of time can lead to significant discomfort by the wearer, in that there is placed a substantial load on the abdomen and back of the wearer with often insufficient support. Improper weight distribution puts a strain on the shoulders, and may lead to serious injury. In some instances, inadequate lower back and abdomen support may develop into or exacerbate chronic medical conditions. Discomfort to the child including chafing and strain may also result.

Accordingly, there remains a need for an infant carrier that can be switched to carry the child between a number of positions and orientations without necessitating repositioning of the child. Additionally, there is a need for an infant carrier that provides proper support and comfort to the wearer and the child, which can be appropriately converted in accordance with each such position and orientation. These needs and others are met by the present invention.

SUMMARY

In accordance with the purpose(s) of the invention, as embodied and broadly described herein, the invention, in one aspect, relates to infant carriers and methods of making same.

Disclosed are carriers comprising a compartment dimensioned to support a child and a harness dimensioned to fit a wearer, wherein the harness is reversibly attached to the compartment, and wherein the carrier is configured such that the wearer can reposition the carrier to selectively support the child facing towards the wearer or away from the wearer, when the harness is on the wearer, without removing the child from the compartment.

Also disclosed are carriers comprising: (a) a compartment dimensioned to support a child, wherein the compartment comprises: (i) a head support member dimensioned to support a child's head, wherein the head support has a top edge; (ii) a first body support member dimensioned to support a child's back, wherein the first body support member has a bottom edge and a pair of side edges, and wherein the first support member is connected to the head support member; and (iii) a second body support member dimensioned to support a child's front, wherein the second body support member has a length, a top edge, a bottom edge, and a pair of side edges, and wherein the second body support member is connected to the first body support member, wherein the first body support member and the second body support member together comprise a seat support member, and wherein the head support member and first body support member together have a length that is longer than the length of the second body support member; and (b) a harness dimensioned to fit a wearer, wherein the harness is attached to the compartment, wherein the harness comprises a pair of straps configured to be worn by the wearer, and wherein each strap has a first end and a second end.

Also disclosed are carriers comprising: (a) a compartment dimensioned to support a child, wherein the compartment comprises: (i) a head support member dimensioned to support a child's head, wherein the head support has a top edge; (ii) a first body support member dimensioned to support a child's back, wherein the first body support member has a bottom edge and a pair of side edges, and wherein the first support member is connected to the head support member; and (iii) a second body support member dimensioned to support a child's front, wherein the second body support member has a length, a top edge, a bottom edge, and a pair of side edges, and wherein the second body support member is connected to the first body support member, wherein the first body support member and the second body support member together comprise a seat support member; and (b) a harness dimensioned to fit a wearer, wherein the harness comprises a pair of straps configured to be worn by the wearer, wherein each strap has a first end and a second end, wherein the first end is connected to the head support member and/or the first body support member, and wherein the second end is connected to the first body support member and/or the second body support member.

While aspects of the present invention can be described and claimed in a particular statutory class, such as the system statutory class, this is for convenience only and one of skill in the art will understand that each aspect of the present invention can be described and claimed in any statutory class. Unless otherwise expressly stated, it is in no way intended that any method or aspect set forth herein be construed as requiring that its steps be performed in a specific order. Accordingly, where a method claim does not specifically state in the claims or descriptions that the steps are to be limited to a specific order, it is no way intended that an order be inferred, in any respect. This holds for any possible non-express basis for interpretation, including matters of logic with respect to arrangement of steps or operational flow, plain meaning derived from grammatical organization or punctuation, or the number or type of aspects described in the specification.

BRIEF DESCRIPTION OF THE FIGURES

The accompanying figures, which are incorporated in and constitute a part of this specification, illustrate several aspects and together with the description serve to explain the principles of the invention.

FIG. 2A shows the interior surface of the carrier (where the child will be located) and FIG. 2B shows the exterior surface of the carrier.

FIG. 3A shows the interior surface of the carrier (where the child will be located) and FIG. 3B shows the exterior surface of the carrier.

FIG. 4A shows the "front" of the carrier (i.e., facing the child's front, when in use), FIG. 4B shows the "back" of the carrier (i.e., facing the child's back, when in use) with the transition region up, and FIG. 4C shows the "back" of the carrier with the transition region down.

Figure 1:
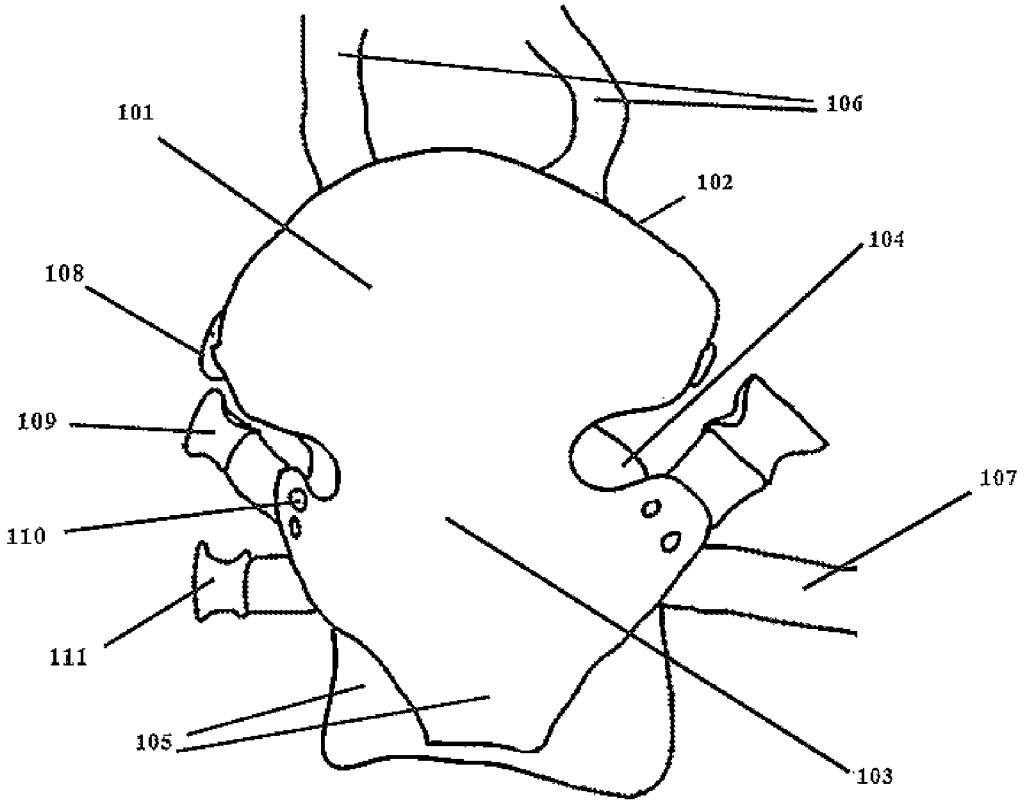
FIG. 1 shows a representative image of a multifunctional carrier that can be re-positioned on a wearer's front or back with a child facing inwards or outwards without removing the child from the carrier.

Additional advantages of the invention will be set forth in part in the description which follows, and in part will be obvious from the description, or can be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

DESCRIPTION

The present invention can be understood more readily by reference to the following detailed description of the invention and the Examples and Figures included herein.

While aspects of the present invention can be described and claimed in a particular statutory class, such as the article of manufacture statutory class, this is for convenience only and one of skill in the art will understand that each aspect of the present invention can be described and claimed in any statutory class. Unless otherwise expressly stated, it is in no way intended that any method or aspect set forth herein be construed as requiring that its steps be performed in a specific order. Accordingly, where a method claim does not specifically state in the claims or descriptions that the steps are to be limited to a specific order, it is no way intended that an order be inferred, in any respect. This holds for any possible non-express basis for interpretation, including matters of logic with respect to arrangement of steps or operational flow, plain meaning derived from grammatical organization or punctuation, or the number or type of aspects described in the specification.

Throughout this application, various publications are referenced. The disclosures of these publications in their entireties are hereby incorporated by reference into this application in order to more fully describe the state of the art to which this pertains. The references disclosed are also individually and specifically incorporated by reference herein for the material contained in them that is discussed in the sentence in which the reference is relied upon. Nothing herein is to be construed as an admission that the present invention is not entitled to antedate such publication by virtue of prior invention. Further, the dates of publication provided herein may be different from the actual publication dates, which can require independent confirmation.

A. Definitions

As used in the specification and the appended claims, the singular forms "a," "an" and "the" include plural referents unless the context clearly dictates otherwise. Thus, for example, reference to "a liner," "a harness," or "a car seat" includes mixtures of two or more such liners, harnesses, or car seats, and the like.

As used herein, the terms "optional" or "optionally" means that the subsequently described event or circumstance can or cannot occur, and that the description includes instances where said event or circumstance occurs and instances where it does not.

B. Carriers

In one aspect, disclosed are carriers comprising a compartment dimensioned to support a child and a harness dimensioned to fit a wearer, wherein the harness is reversibly attached to the compartment, and wherein the carrier is configured such that the wearer can reposition the carrier to selectively support the child facing towards the wearer or away from the wearer, when the harness is on the wearer, without removing the child from the compartment.

In one aspect, disclosed are carriers comprising: (a) a compartment dimensioned to support a child, wherein the compartment comprises: (i) a head support member dimensioned to support a child's head, wherein the head support has a top edge; (ii) a first body support member dimensioned to support a child's back, wherein the first body support member has a bottom edge and a pair of side edges, and wherein the first support member is connected to the head support member; and (iii) a second body support member dimensioned to support a child's front, wherein the second body support member has a length, a top edge, a bottom edge, and a pair of side edges, and wherein the second body support member is connected to the first body support member, wherein the first body support member and the second body support member together comprise a seat support member, and wherein the head support member and first body support member together have a length that is longer than the length of the second body support member; and (b) a harness dimensioned to fit a wearer, wherein the harness is attached to the compartment, wherein the harness comprises a pair of straps configured to be worn by the wearer, and wherein each strap has a first end and a second end.

In one aspect, disclosed are carriers comprising: (a) a compartment dimensioned to support a child, wherein the compartment comprises: (i) a head support member dimensioned to support a child's head, wherein the head support has a top edge; (ii) a first body support member dimensioned to support a child's back, wherein the first body support member has a bottom edge and a pair of side edges, and wherein the first support member is connected to the head support member; and (iii) a second body support member dimensioned to support a child's front, wherein the second body support member has a length, a top edge, a bottom edge, and a pair of side edges, and wherein the second body support member is connected to the first body support member, wherein the first body support member and the second body support member together comprise a seat support member; and (b) a harness dimensioned to fit a wearer, wherein the harness comprises a pair of straps configured to be worn by the wearer, wherein each strap has a first end and a second end, wherein the first end is connected to the head support member and/or the first body support member, and wherein the second end is connected to the first body support member and/or the second body support member.

Referring to FIG. 1, for example, the carrier can comprise a compartment and a harness. As shown here, the compartment comprises head support member 101 having top edge 102, first body support member 103, and second body support member 104. First body support member 103 and second body support member 104 together comprise seat support member 105. Head support member 101 is integral with first body support member 103. As shown here, the harness comprises a pair of straps 106 configured to be worn by a wearer and strap 107 configured to encircle a wearer's waist. As shown here, head support member 101 is reversibly attached to second body support member 104 via attachment members 108. Exemplary attachment members include, but are not limited to, rings, clips, carabiners, swivel-hooks, snaps, snap-hooks, bulldog clips, trigger hooks, and hooks. Alternatively, head support member 101 can be reversibly attached to second body support member 104 via a pair of straps having an attachment member thereon or via a single strap having a first attachment member and a second attachment member directly connected to either the head support member or the second body support member, wherein the second attachment member is configured for engagement with the first attachment member. As shown here, each strap 106 is connected to top edge 102 by, for example, a seam. Alternatively, each strap can be reversibly attached to the head support member via an attachment member. In various aspects, the adjacent end of the straps (not shown) may comprise an attachment member configured for engagement with attachment members 109. In this way, each strap can be extended over a wearer's shoulder and around a wearer's torso and then joined to attachment member 109. First body support member 103 is reversibly attached to second body support member 104 via attachment members 110. As shown here, attachment members 110 comprise snaps, although other attachment members such as, for example, rings, clips, carabiners, swivel-hooks, snaps, snap-hooks, bulldog clips, trigger hooks, and hooks are also envisioned. As shown here, one end of strap 107 comprises attachment member 111, which is configured for engagement with a second attachment member (not shown) on the opposing end of strap 107. Alternative means of connecting strap 107 are also envisioned. For example, each end of strap 107 can reversibly attach to the compartment. In a further example, each end of strap 107 may not comprise an attachment member. Rather, each end could merely be extended around a wearer's waist and securely fastened.

Figure 2A:
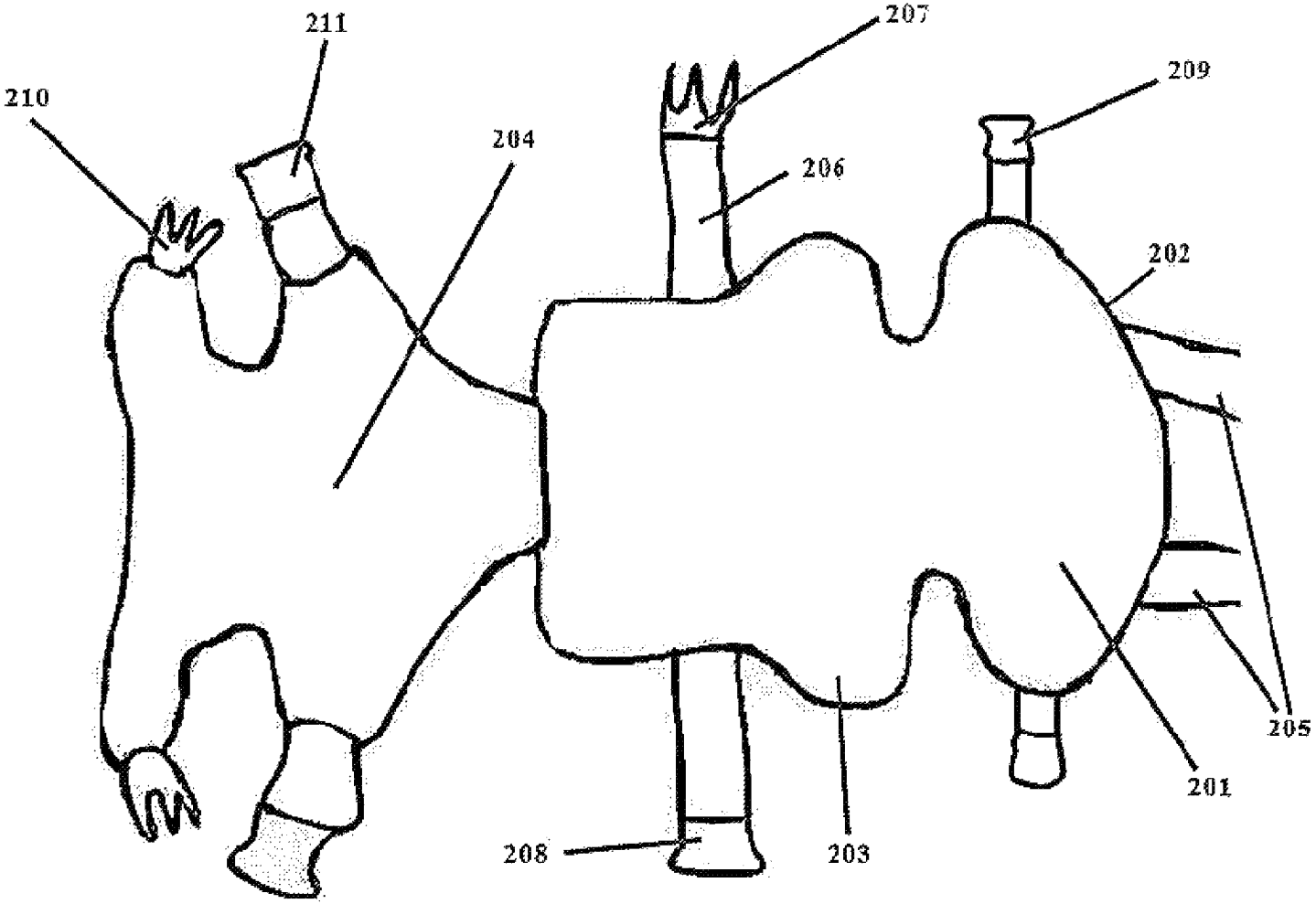
FIG. 2A and FIG. 2B show representative images of a multifunctional carrier in which the compartment is not dimensioned to support a child in a car seat. Specifically.
Figure 2B:
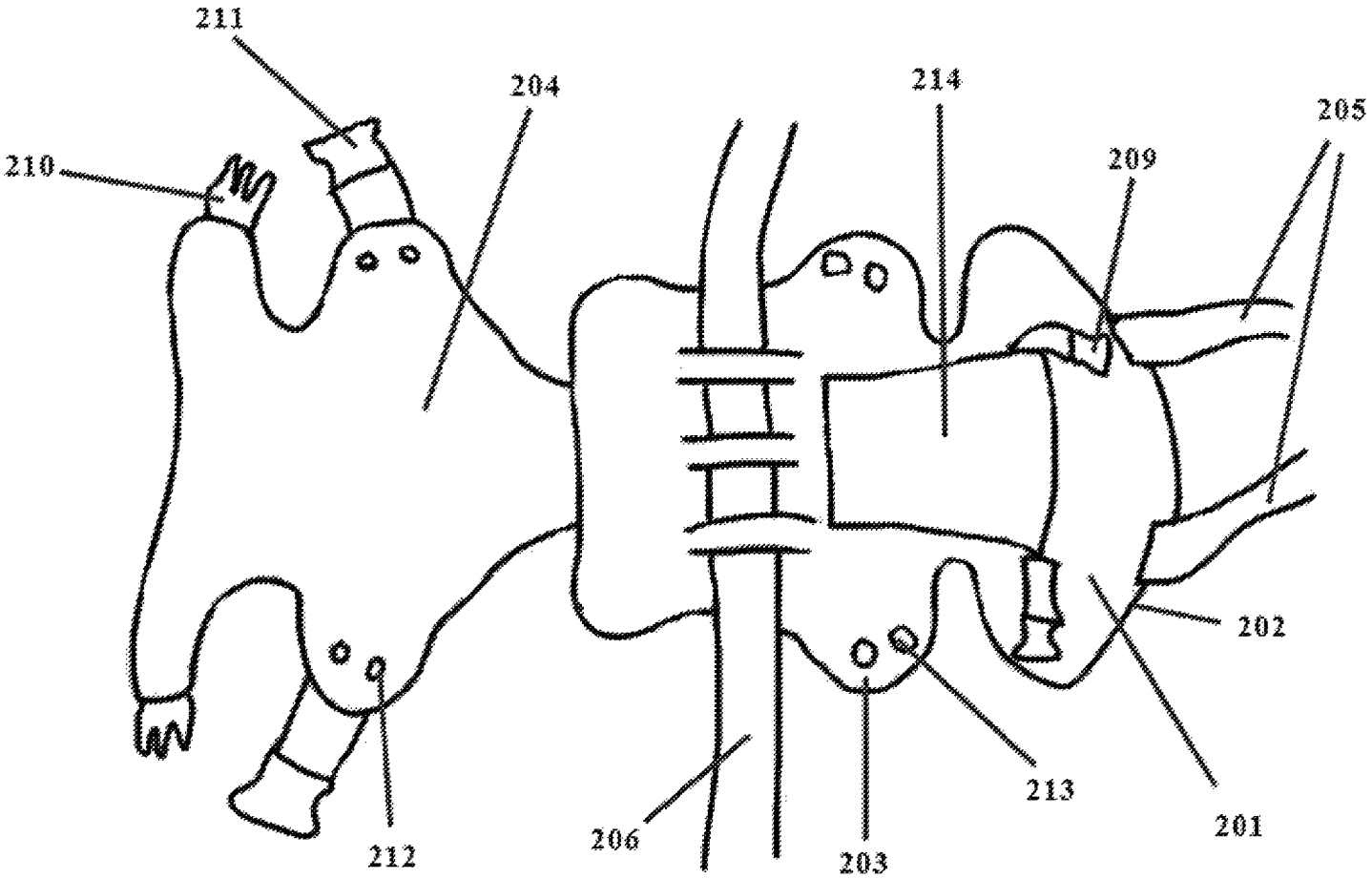

Referring to FIG. 2A and FIG. 2B, for example, the carrier can comprise a compartment and a harness. As shown here, the compartment comprises head support member 201 having top edge 202, first body support member 203, and second body support member 204. Head support member 201 is integral with first body support member 203. Head support member 201 and first body support member 203 together have a length that is longer than the length of second body support member 204. As shown here, the harness comprises a pair of straps 205 configured to be worn by a wearer and strap 206 configured to encircle a wearer's waist. As shown here, strap 206 comprises a first attachment member 207, which is configured for engagement with a second attachment member 208, although alternative means of connecting strap 206 are also envisioned as detailed herein. As shown here, strap 206 is woven through first body support member 203, and can thus be removed or adjusted as needed. Alternatively, strap 206 can be connected to first body support member 203 via a seam or reversibly attached to first body support member 203 via attachment members. As shown here, head support member 201 is configured to reversibly attach to second body support member 204 via a pair of first attachment members 209 and a pair of second attachment members 210, wherein attachment members 209 are configured for engagement with attachment members 210. Attachment members 209 can be connected to a surface of head support member 201, as shown here. Alternatively, attachment members 209 can be connected to a side edge or a top edge of head support member 201. As shown here, each strap 205 is connected to top edge 202 by, for example, a seam. Alternatively, each strap can be reversibly attached to the head support member via an attachment member. In various aspects, the adjacent end of the straps (not shown) may comprise an attachment member configured for engagement with a pair of attachment members 211. In this way, each strap can be extended over a wearer's shoulder and around a wearer's torso and then joined to attachment member 211. First body support member 203 is configured to reversibly attach to second body support member 204 via attachment members 212. As shown here, attachment members 212 comprise snaps, although other attachment members such as, for example, rings, clips, carabiners, swivel-hooks, snaps, snap-hooks, bulldog clips, trigger hooks, and hooks are also envisioned.

Figure 3A:
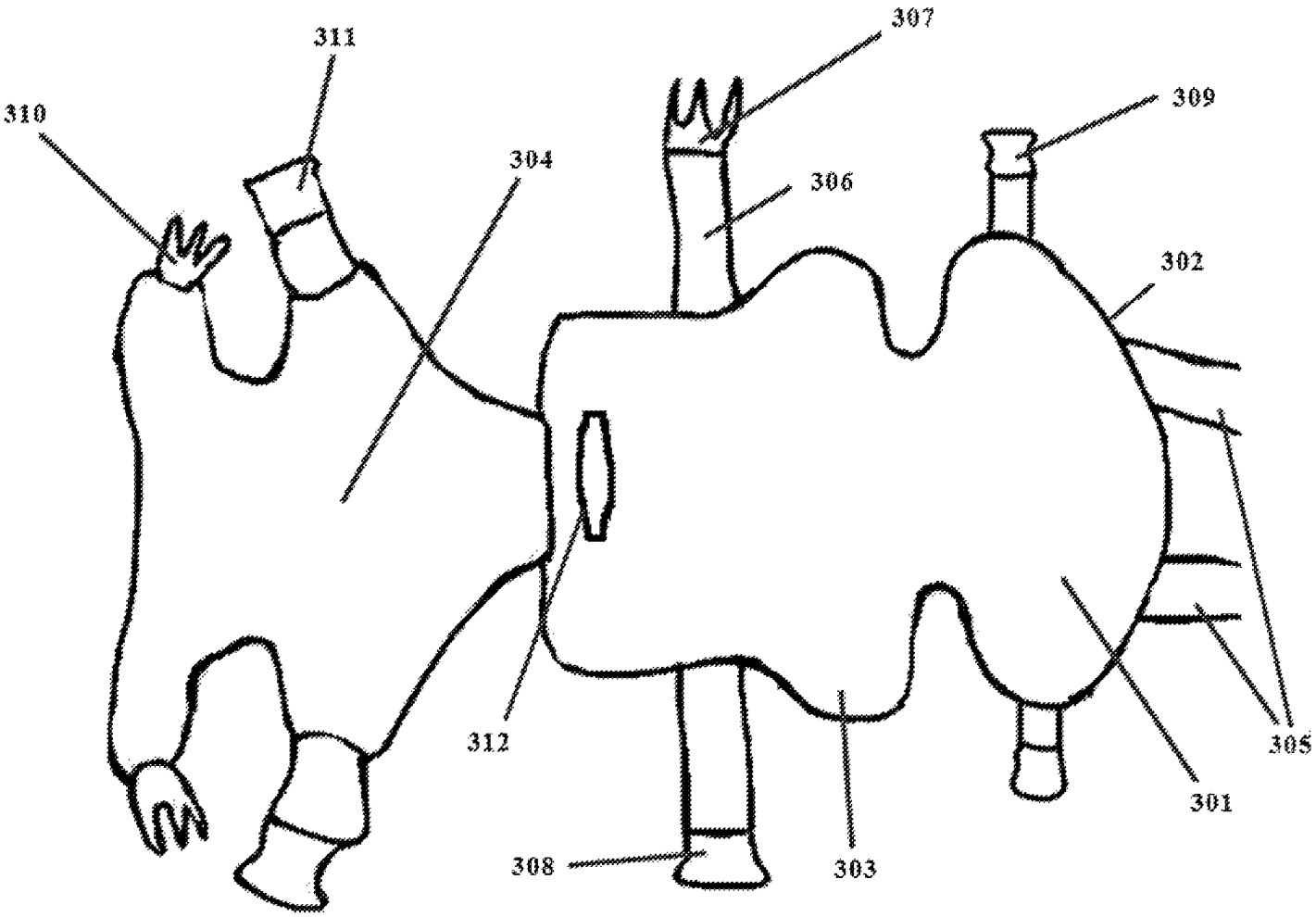
FIG. 3A and FIG. 3B show representative images of a multifunctional carrier in which the compartment is dimensioned to support a child in a car seat. Specifically.
Figure 3B:
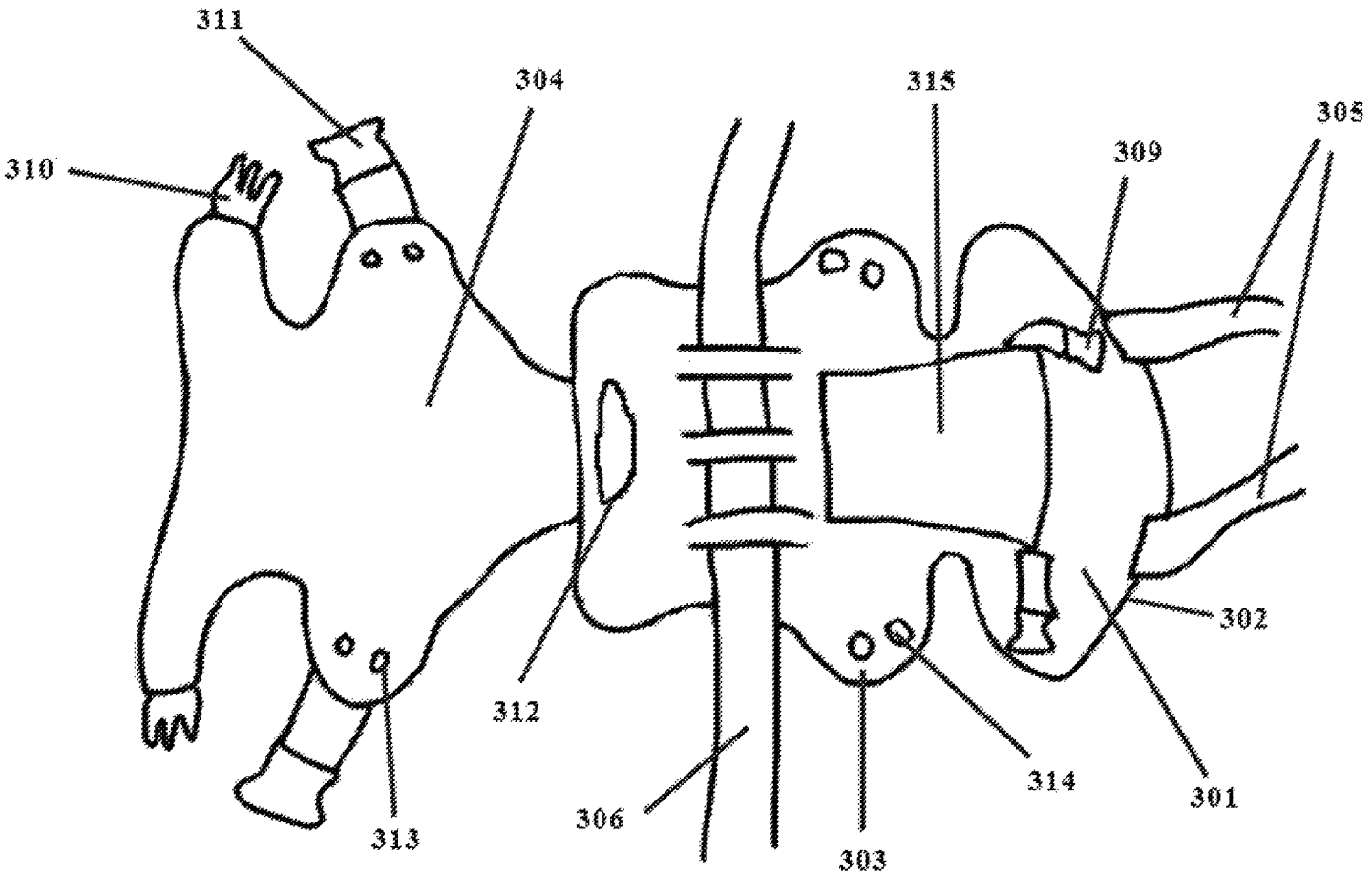

Referring to FIG. 3A and FIG. 3B, for example, the carrier can comprise a compartment and a harness. As shown here, the compartment comprises head support member 301 having top edge 302, first body support member 303, and second body support member 304. Head support member 301 is integral with first body support member 303. Head support member 301 and first body support member 303 together have a length that is longer than the length of second body support member 304. As shown here, the harness comprises a pair of straps 305 configured to be worn by a wearer and strap 306 configured to encircle a wearer's waist. As shown here, strap 306 comprises a first attachment member 307, which is configured for engagement with a second attachment member 308, although alternative means of connecting strap 306 are also envisioned as detailed herein. As shown here, strap 306 is woven through first body support member 303, and can thus be removed or adjusted as needed. Alternatively, strap 306 can be connected to first body support member 303 via a seam or reversibly attached to first body support member 303 via attachment members. As shown here, head support member 301 is configured to reversibly attach to second body support member 304 via a pair of first attachment members 309 and a pair of second attachment members 310, wherein attachment members 309 are configured for engagement with attachment members 310. Attachment members 309 can be connected to a surface of head support member 301, as shown here. Alternatively, attachment members 309 can be connected to a side edge or a top edge of head support member 301. As shown here, each strap 305 is connected to top edge 302 by, for example, a seam. Alternatively, each strap can be reversibly attached to the head support member via an attachment member. In various aspects, the adjacent end of the straps (not shown) may comprise an attachment member configured for engagement with a pair of attachment members 311. In this way, each strap can be extended over a wearer's shoulder and around a wearer's torso and then joined to attachment member 311. As shown here, first body support member 303 comprises an inner edge 312 that defines a hole whereby a seatbelt could be pulled through. Thus, it would be understood by one skilled in the art that a carrier may be dimensioned to support a child in a car seat by, for example, allowing a seat belt to be pulled through a hole and securely fastened to a car seat harness. First body support member 303 is configured to reversibly attach to second body support member 304 via attachment members 313. As shown here, attachment members 313 comprise snaps, although other attachment members such as, for example, rings, clips, carabiners, swivel-hooks, snaps, snap-hooks, bulldog clips, trigger hooks, and hooks are also envisioned.

Figure 4A:
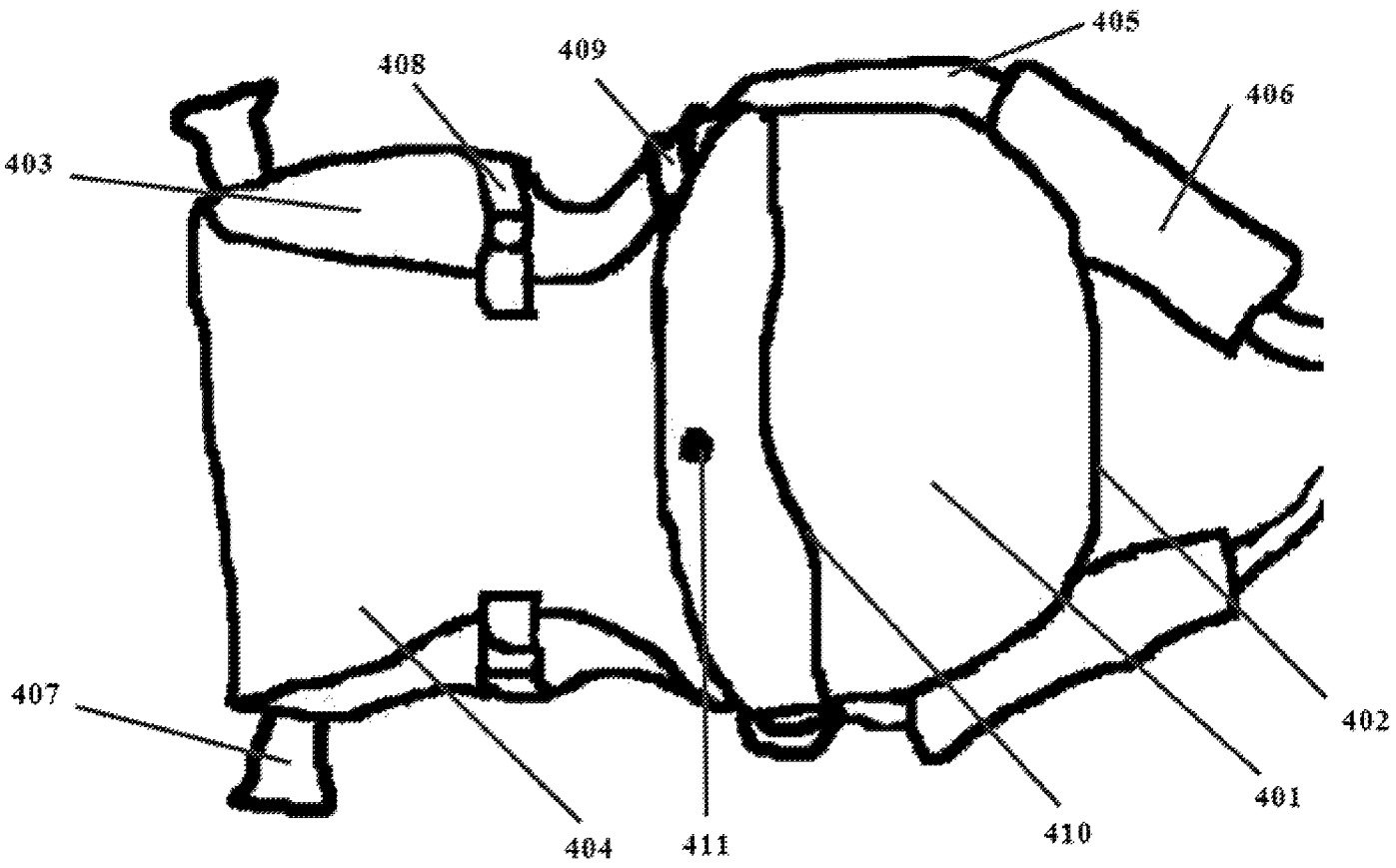
FIG. 4A-C show representative images of a multifunctional carrier having a transition region. Specifically.
Figure 4B:
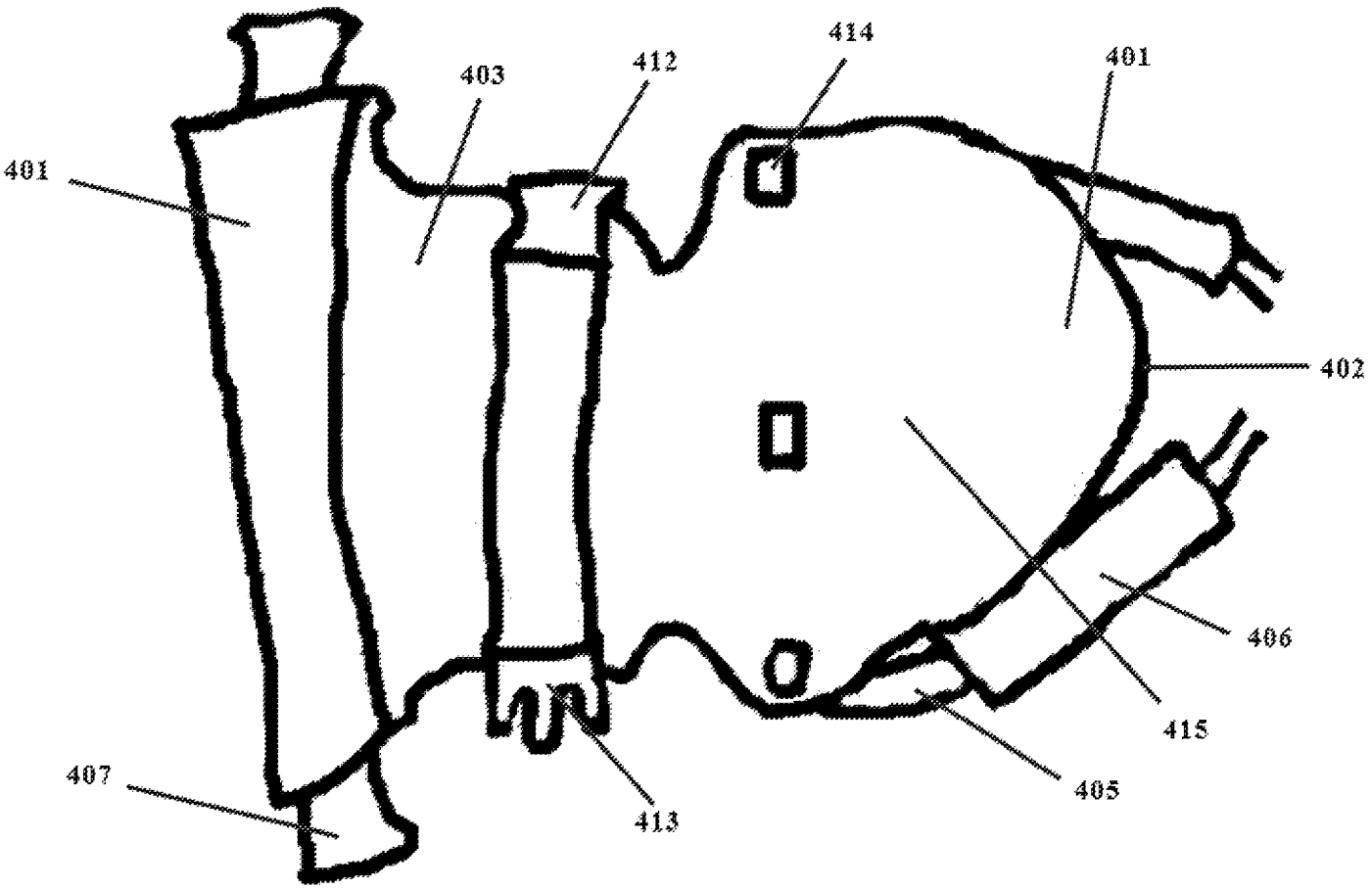
Figure 4C:
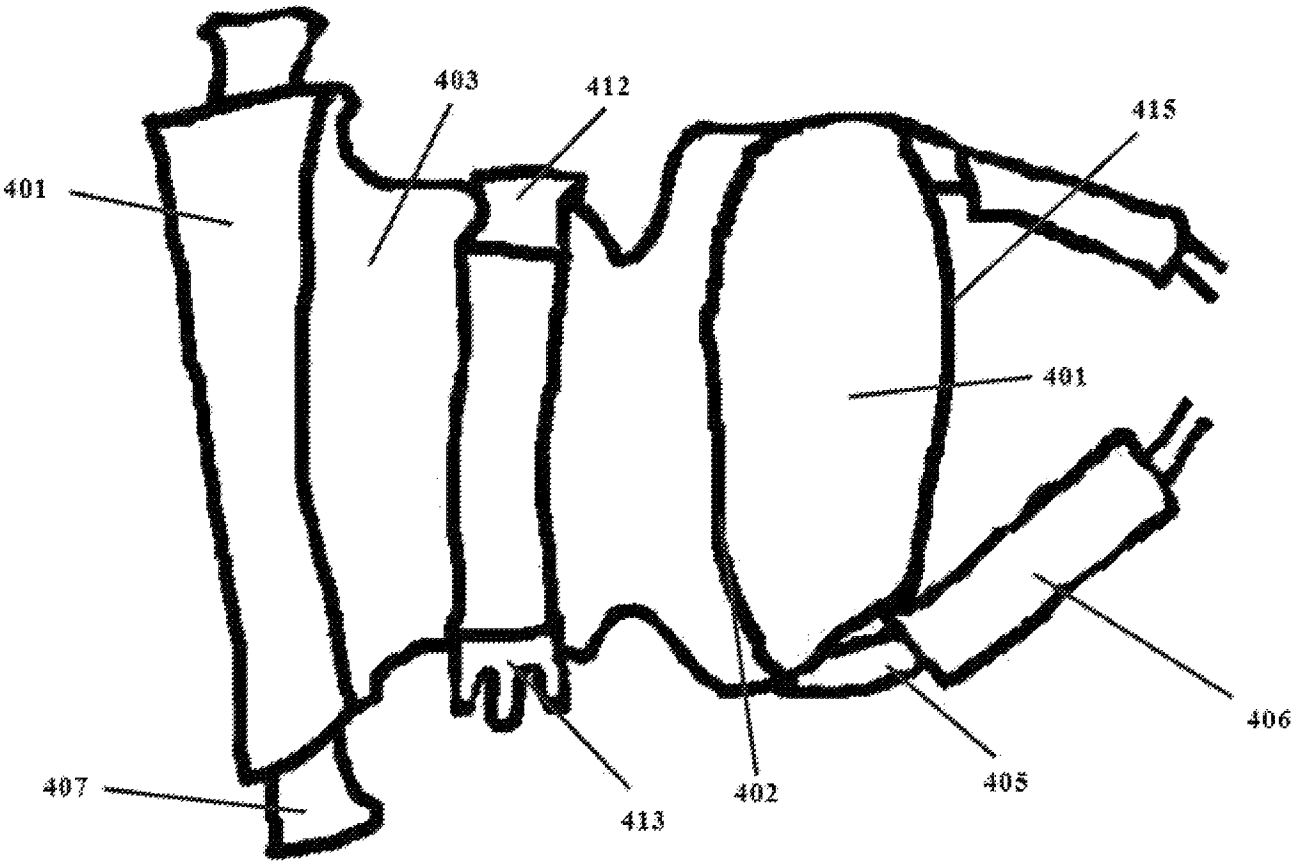

Referring to FIG. 4A-C, for example, the carrier can comprise a compartment and a harness. As shown here, the compartment comprises head support member 401 having top edge 402, first body support member 403, and second body support member 404. Head support member 401 is integral with first body support member 403. Head support member 401 and first body support member 403 together have a length that is longer than the length of second body support member 404. As shown here, the harness comprises a pair of straps 405 configured to be worn by a wearer, wherein each strap 405 is inserted through padded member 406, which may provide additional comfort and/or support to a wearer's shoulders. As shown here, each side edge of first body support member 403 comprises a first pair attachment member reversibly attached to a second attachment member located on each side edge of second body support member 404 (collectively shown as 409). Exemplary attachment members include, but are not limited to, rings, clips, carabiners, swivel-hooks, snaps, snap-hooks, bulldog clips, trigger hooks, and hooks. Alternatively, first body support member 403 can be reversibly attached to second body support member 404 via a pair of straps having an attachment member thereon or via a single strap having a first attachment member and a second attachment member directly connected to either the first body support member or the second body support member, wherein the second attachment member is configured for engagement with the first attachment member. As shown here, each side edge of first body support member 403 comprises a third attachment member reversibly attached to a fourth attachment member located on each side edge of second body support member 404 (collectively shown as 408). Each attachment member can be on a strap, as shown here, or can be directly connected to the support member, or any combination thereof. As shown here, each strap 405 is connected to second body support member 404 by, for example, a seam. Alternatively, each strap can be reversibly attached to the second body support member via an attachment member. In various aspects, the adjacent end of the straps (not shown) may comprise an attachment member configured for engagement with a pair of attachment members 412 and 413. In this way, each strap can be extended over a wearer's shoulder and around a wearer's torso and then joined to attachment members 412 and 413. Finally, as shown here, first body support member 403 may comprise a pair of attachment members 407, which can be reversibly attached to a pair of attachment members on a strap configured to encircle a wearer's waist (not shown).

Referring to FIG. 4A, for example, the carrier can comprise a compartment and a harness, wherein the compartment comprises transition region 410 within second body support member 404. As shown here, transition region 410 is configured to allow second support member 404 to be selectively moved between an unfolded position and folded position (folded position is shown in FIG. 4A). The folded position may be secured by snap 411, although over attachment means are also envisioned.

Referring to FIGS. 4B and 4C, for example, the carrier can comprise a compartment and a harness, wherein the compartment comprises transition region 415 defined between first support member 403 and head support member 401. As shown here, transition region 415 is configured to allow head support member 401 to be selectively moved between an unfolded position (FIG. 4B) and a folded position (FIG. 4C). The folded position may be secured by hook-and-loops on strips 414, although other attachment means are also envisioned.

Figure 7A:
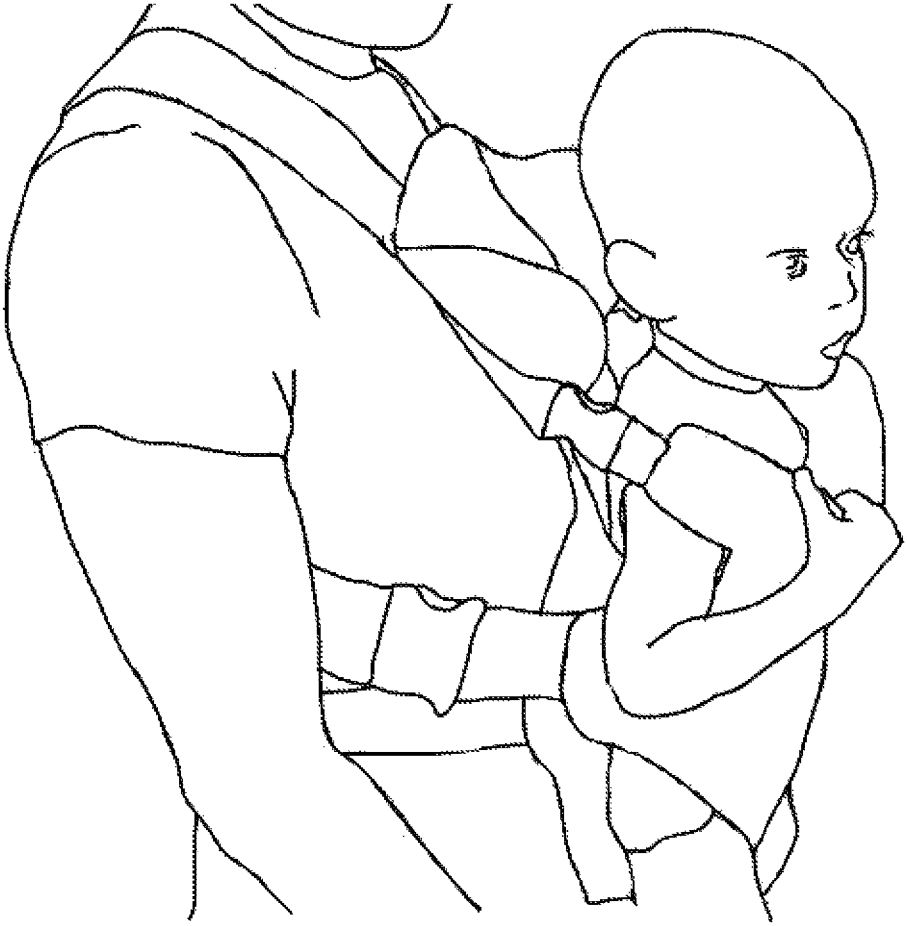
FIG. 7A and FIG. 7B show representative images of a carrier in use from the side (7A) and back (7B).
Figure 7B:
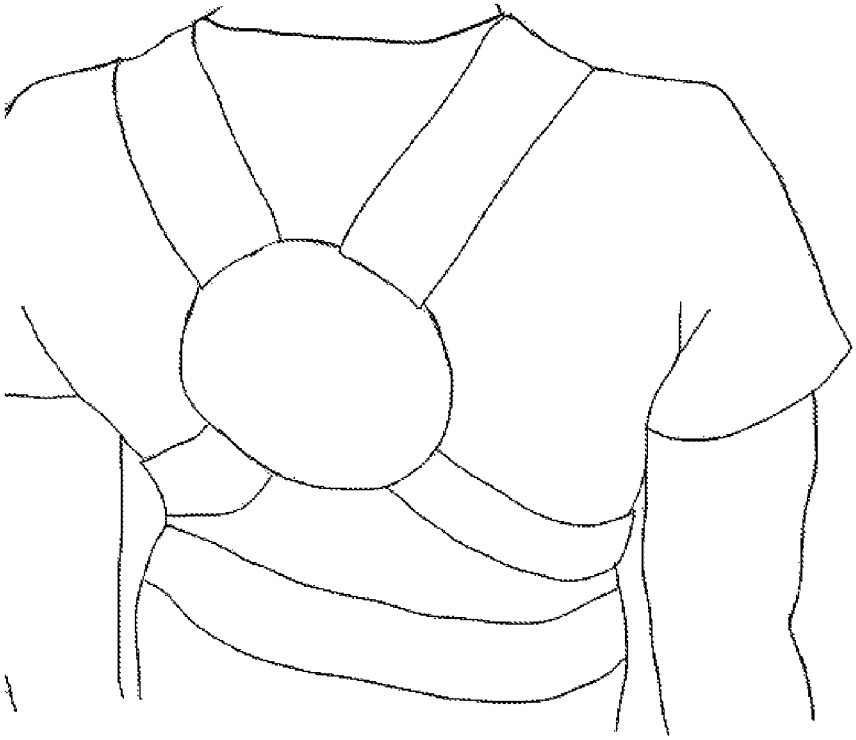

Referring to FIGS. 7A and FIG. 7B, representative images of an exemplary carrier as disclosed herein. Specifically, representative images of a carrier comprising a compartment and a harness, wherein the compartment is positioned on a wearer's front with a child facing outwards from the side (FIG. 7A) and back (FIG. 7B) are shown. As shown, the carrier could be repositioned on a wearer's front with a child facing inwards without removing the child from the compartment. Similarly, the carrier could be repositioned on a wearer's back with a child facing inwards or outwards without removing the child from the compartment.

In a further aspect, the compartment and the harness are integral. In a still further aspect, the compartment and the harness are distinct components.

In a further aspect, the carrier is dimensioned so that in operable condition the compartment is on the front of the wearer. In a still further aspect, the carrier is dimensioned so that in operable condition the compartment is on the front of the wearer and the child faces the wearer. In yet a further aspect, the carrier is dimensioned so that in operable condition the compartment is on the front of the wearer and the child opposes the wearer.

In a further aspect, the carrier is dimensioned so that in operable condition the compartment is on the back of the wearer. In a still further aspect, the carrier is dimensioned so that in operable condition the compartment is on the back of the wearer and the child faces the wearer. In yet a further aspect, the carrier is dimensioned so that in operable condition the compartment is on the back of the wearer and the child opposes the wearer.

1. Compartments

In one aspect, the disclosed carrier comprises a compartment dimensioned to support a child.

In a further aspect, the compartment is not dimensioned to support a child in a car seat. For example, a compartment dimensioned to support a child in a car seat may comprise a surface having an inner edge defining a hole, whereby a car seat strap can be manipulated through. Thus, in various aspects, the disclosed compartment comprises a surface lacking an inner edge defining a hole dimensioned to accept a seatbelt buckle. Alternatively, the compartment comprises a surface having exactly two inner edges, wherein each edge defines a hole, and wherein each hole is dimensioned to allow a child's leg to be insertable through the opening. In another example, a compartment dimensioned to support a child in a car seat may be shaped so as to allow a car seat strap to be easily manipulated around the compartment. Thus, in various aspects, the disclosed compartment is shaped such that a car seat strap cannot easily be accessed.

In one aspect, the disclosed carrier comprises a compartment dimensioned to support a child, wherein the compartment comprises: (a) a head support member dimensioned to support a child's head, wherein the head support has a top edge; (b) a first body support member dimensioned to support a child's back, wherein the first body support member has a bottom edge and a pair of side edges, and wherein the first support member is connected to the head support member; and (c) a second body support member dimensioned to support a child's front, wherein the second body support member has a length, a top edge, a bottom edge, and a pair of side edges, and wherein the second body support member is connected to the first body support member, wherein the first body support member and the second body support member together comprise a seat support member.

In a further aspect, the compartment comprises: (a) a head support member dimensioned to support a child's head, wherein the head support has a top edge; (b) a first body support member dimensioned to support a child's back, wherein the first body support member has a bottom edge and a pair of side edges, and wherein the first support member is connected to the head support member; and (c) a second body support member dimensioned to support a child's front, wherein the second body support member has a length, a top edge, a bottom edge, and a pair of side edges, and wherein the second body support member is connected to the first body support member, wherein the first body support member and the second body support member together comprise a seat support member, and wherein the head support member and first body support member together have a length that is longer than the length of the second body support member.

In a further aspect, the compartment has a top edge and the top edge defines a hole. In a still further aspect, in operation, the compartment is dimensioned to allow a child's face to extend out of the hole. In yet a further aspect, in operation, the compartment is dimensioned to allow a child's head to extend out of the hole.

Thus, in various aspects, the compartment may resemble a pouch in which a child can be retained in an upright position with their legs maintained inside the pouch. This may be especially beneficial for young infants who are most comfortable curled up akin to being inside their mother's womb. Moreover, this position may also help a child to stay warm while being transported about.

In a further aspect, the compartment has two inner edges and each inner edge defines a hole. In a still further aspect, in operation, the compartment is dimensioned to allow a child's legs to extend of each hole. In yet a further aspect, the compartment has exactly two inner edges, wherein each edge defines a hole, and wherein each hole is dimensioned to allow a child's leg to be insertable through the opening.

Thus, in various aspects, the compartment may resemble a pouch in which a child can be retained in an upright position with their legs extended out of the pouch. In this position, the legholes may be strategically placed to help the child maintain the ergonomic "M" positioning, with the child's knees higher than the child's bottom.

In a further aspect, the compartment can be positioned on a wearer's abdomen or on a wearer's back. In a still further aspect, the compartment can be positioned on a wearer's abdomen. In yet a further aspect, the compartment can be positioned on a wearer's back.

In a further aspect, the compartment can be positioned so that, in operation, a child faces the wearer. In a still further aspect, the compartment can be positioned so that, in operation, a child faces away from the wearer.

In a further aspect, the compartment has a width of from about 7 inches to about 20 inches. In a still further aspect, the compartment has a width of from about 7 inches to about 18 inches. In yet a further aspect, the compartment has a width of from about 7 inches to about 16 inches. In an even further aspect, the compartment has a width of from about 7 inches to about 14 inches. In a still further aspect, the compartment has a width of from about 7 inches to about 12 inches. In yet a further aspect, the compartment has a width of from about 7 inches to about 10 inches. In an even further aspect, the compartment has a width of from about 10 inches to about 20 inches. In a still further aspect, the compartment has a width of from about 12 inches to about 20 inches. In yet a further aspect, the compartment has a width of from about 14 inches to about 20 inches. In an even further aspect, the compartment has a width of from about 16 inches to about 20 inches.

In a further aspect, the compartment has a length of from about 12 inches to about 20 inches. In a still further aspect, the compartment has a length of from about 12 inches to about 18 inches. In yet a further aspect, the compartment has a length of from about 12 inches to about 16 inches. In an even further aspect, the compartment has a length of from about 12 inches to about 14 inches. In a still further aspect, the compartment has a length of from about 14 inches to about 20 inches. In yet a further aspect, the compartment has a length of from about 16 inches to about 20 inches. In an even further aspect, the compartment has a length of from about 18 inches to about 20 inches.

In a further aspect, the compartment has a weight capacity of about 50 lbs. In a still further aspect, the compartment has a weight capacity of about 45 lbs. In yet a further aspect, the compartment has a weight capacity of about 40 lbs. In an even further aspect, the compartment has a weight capacity of about 35 lbs. In a still further aspect, the compartment has a weight capacity of about 30 lbs. In yet a further aspect, the compartment has a weight capacity of about 25 lbs.

a. Head Support Members

In a further aspect, the compartment comprises a head support member dimensioned to support a child's head, wherein the head support member has a top edge. For example, the head support member can support the back and/or sides of a child's head. Young infants do not have enough strength in their necks to hold their heads up to keep their airways open. Rather, their heads tend to flop sideways, forward, or even backward. Placing support behind and alongside the infant's head can prevent this movement and improve head positioning. Thus, in various aspects, the head support member, in operation, is so dimensioned as to support the back of a child's head. In a further aspect, the head support member, in operation, is so dimensioned as to support the sides of a child's head. In a still further aspect, the head support member, in operation, is so dimensioned as to support the back and sides of a child's head.

The head support member can be formed of any suitable material that provides good cushioning. Exemplary materials include, but are not limited to, waterproof nylon, flannel, and elastic fabrics such as spandex or cotton-spandex blends.

The head support member can optionally be filled with a compressible, resilient material. Exemplary fillers include, but are not limited to, polyester fiberfill, down feathers, memory foam, and polystyrene pellets. In various aspects, the head support member can optionally comprise an inflatable inner liner.

In a further aspect, the head support member is integral with the first body support member. In a still further aspect, the head support member and the first body support member are distinct components.

In a further aspect, the head support member and the first body support member together have a length that is longer than the length of the second body support member. In a still further aspect, the head support member and the first body support member together have a length that is at least 4 inches longer than the length of the second body support member. In yet a further aspect, the head support member and the first body support member together have a length that is at least 5 inches longer than the length of the second body support member. In an even further aspect, the head support member and the first body support member together have a length that is at least 6 inches longer than the length of the second body support member. In a still further aspect, the head support member and the first body support member together have a length that is at least 7 inches longer than the length of the second body support member. In yet a further aspect, the head support member and the first body support member together have a length that is at least 8 inches longer than the length of the second body support member. In an even further aspect, the head support member and the first body support member together have a length that is at least 9 inches longer than the length of the second body support member. In a still further aspect, the head support member and the first body support member together have a length that is at least 10 inches longer than the length of the second body support member. In yet a further aspect, the head support member and the first body support member together have a length that is at least 11 inches longer than the length of the second body support member. In an even further aspect, the head support member and the first body support member together have a length that is at least 12 inches longer than the length of the second body support member.

b. Body Support Members

In a further aspect, the compartment comprises: (a) a first body support member dimensioned to support a child's back, wherein the first body support member has a bottom edge and a pair of side edges, and wherein the first support member is connected to the head support member; and (b) a second body support member dimensioned to support a child's front, wherein the second body support member has a length, a top edge, a bottom edge, and a pair of side edges, and wherein the second body support member connected to the first bdoy support member. In various aspects, the first body support member is dimensioned to support the back and sides of a child's body. In further various aspects, the second body support member is dimensioned to support the front and sides of a child's body.

A body support member can improve the overall comfort and fit of a child. For example, if a child is not adequately supported, the child's body will slump down, causing their chin to rest close to their chest. In this position, the child's airway is not open enough and the child's breathing may be compromised. In extreme circumstances, a small child may even begin to slide out of the carrier. Thus, the body support member serves to cradle the child's body, maintaining the healthy curve of the child's spine. The body support member further serves to help the child maintain the ergonomic "M" positioning, with the child's knees higher than the child's bottom.

A body support member can also improve the comfort and fit of a wearer. For example, a carrier that fails to support a child will sag and put additional strain on the wearer. The body support member thus snugly holds the child in place close to the body of the wearer.

In various aspects, the first body support member and the second body support member together comprise a seat support member. In a further aspect, the seat support member comprises two openings dimensioned to allow a child's leg to be insertable through each opening. In a still further aspect, the seat support member comprises exactly two openings dimensioned to allow a child's leg to be insertable through the opening.

In a further aspect, each opening is laterally spaced apart from each other. In a still further aspect, each opening is laterally spaced approximately 12 inches apart from each other. In yet a further aspect, each opening is laterally spaced approximately 11 inches apart from each other. In an even further aspect, each opening is laterally spaced approximately 10 inches apart from each other. In a still further aspect, each opening is laterally spaced approximately 9 inches apart from each other. In yet a further aspect, each opening is laterally spaced approximately 8 inches apart from each other. In an even further aspect, each opening is laterally spaced approximately 7 inches apart from each other. In a still further aspect, each opening is laterally spaced approximately 6 inches apart from each other. In yet a further aspect, each opening is laterally spaced approximately 5 inches apart from each other. In an even further aspect, each opening is laterally spaced approximately 4 inches apart from each other. In a still further aspect, each opening is laterally spaced approximately 2 inches apart from each other. In yet a further aspect, each opening is laterally spaced approximately 1 inch apart from each other.

In a further aspect, each opening has a diameter of from about 3 inches to about 6 inches. In a still further aspect, each opening has a diameter of from about 3 inches to about 5 inches. In yet a further aspect, each opening has a diameter of from about 3 inches to about 4 inches. In an even further aspect, each opening has a diameter of from about 4 inches to about 6 inches. In a still further aspect, each opening has a diameter of from about 5 inches to about 6 inches. In yet a further aspect, each opening has a diameter of about 3 inches. In an even further aspect, each opening has a diameter of about 4 inches. In yet a further aspect, each opening has a diameter of about 5 inches. In an even further aspect, each opening has a diameter of about 6 inches.

The body support member can be formed of any suitable material that provides good cushioning. Exemplary materials include, but are not limited to, waterproof nylon, flannel, and elastic fabrics such as spandex or cotton-spandex blends.

The body support member can optionally be filled with a compressible, resilient material. Exemplary fillers include, but are not limited to, polyester fiberfill, down feathers, memory foam, and polystyrene pellets. In various aspects, the body support member can optionally comprise an inflatable inner liner.

In a further aspect, the first body support member is integral with the second body support member. In a still further aspect, the first body support member and the second body support member are distinct components.

In a further aspect, the bottom edge of the first body support member is integral with the bottom edge of the second body support member. In a still further aspect, the bottom edge of the first body support member and the bottom edge of the second body support member are distinct components.

In a further aspect, each side edge of the first body support member comprises a first attachment member, each side edge of the second body support member comprises a second attachment member, and the first attachment member is configured for engagement with the second attachment member. Examples of attachment members include, but are not limited to, buckles, hook-and-loop fasteners, rings, clips, carabiners, swivel-hooks, snaps, snap-hooks, bulldog clips, trigger hooks, and hooks.

In a further aspect, each side edge of the first body support member comprises a third attachment member, each side edge of the second body support member comprises a fourth attachment member, and the third attachment member is configured for engagement with the fourth attachment member. Examples of attachment members include, but are not limited to, buckles, hook-and-loop fasteners, rings, clips, carabiners, swivel-hooks, snaps, snap-hooks, bulldog clips, trigger hooks, and hooks.

2. Harnesses

In one aspect, the disclosed carrier comprises a harness dimensioned to fit a wearer, wherein the harness is reversibly attached to the compartment.

In one aspect, the disclosed carrier comprises a harness dimensioned to fit a wearer, wherein the harness is attached to the compartment, wherein the harness comprises a pair of straps configured to be worn by the wearer, and wherein each strap has a first end and a second end.

In one aspect, the disclosed carrier comprises a harness dimensioned to fit a wearer, wherein the harness comprises a pair of straps configured to be worn by the wearer, wherein each strap has a first end and a second end, wherein the first end is connected to the head support member and/or the first body support member, and wherein the second end is connected to the first body support member and/or the second body support member.

Figure 5:
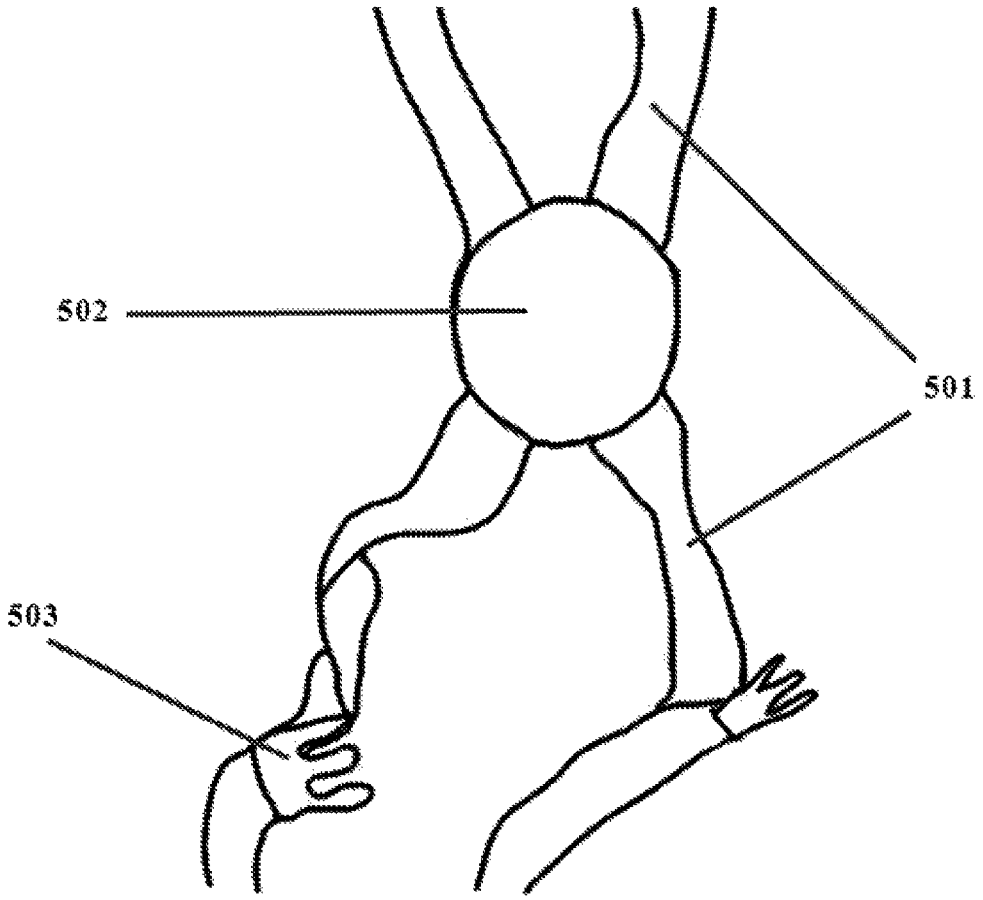
FIG. 5 shows a representative image of a harness having a pair of straps and a back support member.

Referring to FIG. 5, for example, the harness comprises a pair of straps 501 and a back support member 502. Each strap 501 comprises an attachment member 503 configured for engagement with an attachment member on the compartment, thereby allowing the harness to be reversibly attached to the compartment of the carrier. As shown here, attachment members 503 can comprise the male component of a side release buckle but other attachment members such as, for example, a clip and a snap, are also envisioned.

Figure 6:
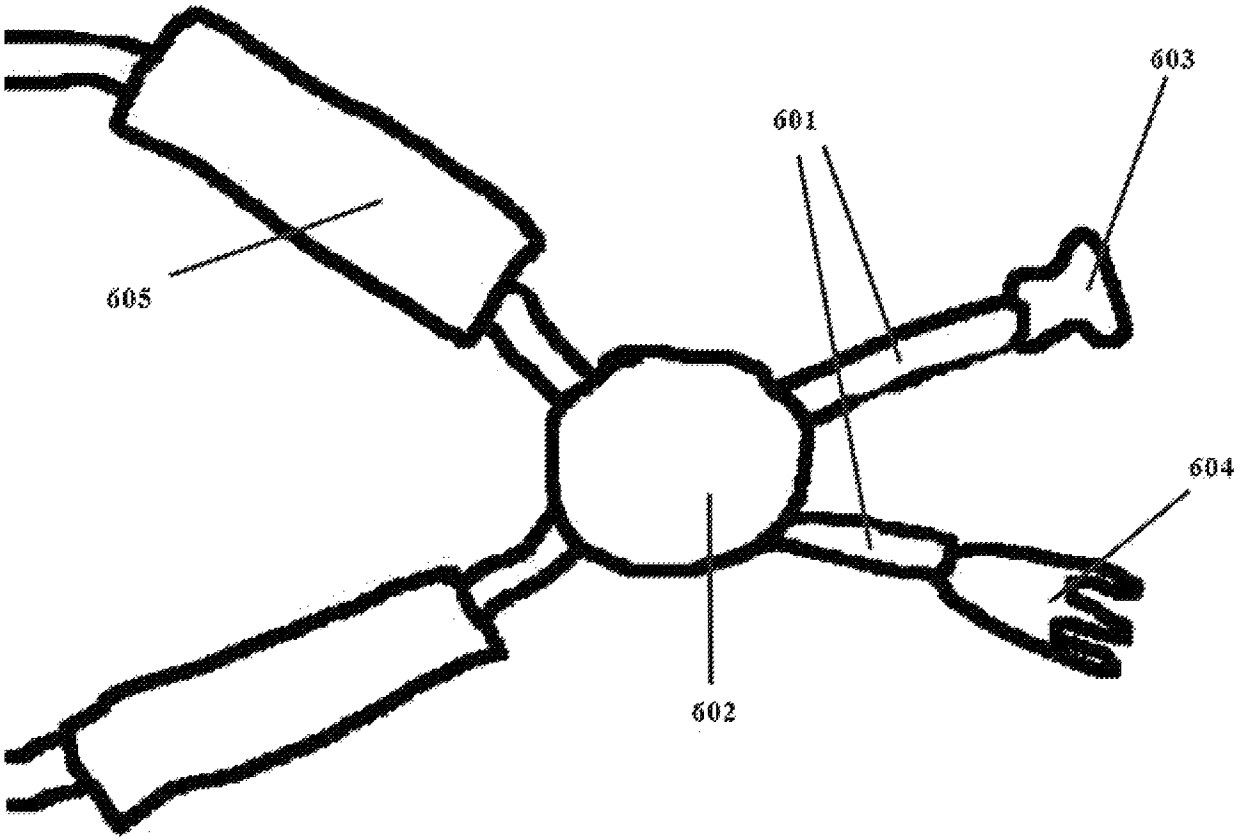
FIG. 6 shows a representative image of a harness having a pair of straps, a back support member, and a padded member.

Referring to FIG. 6, for example, the harness comprises a pair of straps 601 and a back support member 602. Each strap 601 comprises either female attachment member 603 or male attachment member 604, wherein each attachment member is configured for engagement with an attachment member on the compartment, thereby allowing the harness to be reversibly attached to the compartment of the carrier. As shown here, each strap 601 is inserted through padded member 605, which may provide additional comfort and/or support to a wearer's shoulders.

In a further aspect, the harness is reversibly attached to the compartment. For example, the harness can be reversibly attached to the compartment via attachment members. In a still further aspect, the harness is fixedly attached to the compartment. For example, the harness can be fixedly attached to the compartment via a seam.

In a further aspect, the first end is reversibly connected to the head support member and/or the first body support member. In a still further aspect, the first end is fixedly connected to the head support member and/or the first body support member.

In a further aspect, the second end is reversibly connected to the first body support member and/or the second body support member. In a still further aspect, the second end is fixedly connected to the first body support member and/or the second body support member.

In a further aspect, each first end is connected to the head support member. In a still further aspect, each first end is connected to the first body support member. In yet a further aspect, each first end is connected to the head support member and the first body support member. In an even further aspect, each first end is connected to the top edge of the head support member.

In a further aspect, each second end is connected to the first body support member. In a still further aspect, each second end is connected to the second body support member. In yet a further aspect, each second end is connected to the first body support member and the second body support member.

In a further aspect, the harness comprises a pair of straps configured to be worn by the wearer, wherein each strap has a first end and a second end, and wherein each end is connected to the compartment. In a still further aspect, each first end is connected to the compartment via a seam. In yet a further aspect, each second end is connected to the compartment via a seam. In an even further aspect, each first end comprises an attachment member that is configured for engagement with an attachment member on the first body support member. In a still further aspect, each first end comprises an attachment member that is configured for engagement with an attachment member on the head support member. In yet a further aspect, each second end comprises an attachment member that is configured for engagement with an attachment member on the first body support member. In an even further aspect, each second end comprises an attachment member that is configured for engagement with an attachment member on the second body support member.

In a further aspect, each strap is extensible over a wearer's shoulders and around a wearer's torso. In a further aspect, each strap is extensible around a wearer's shoulders.

In a further aspect, the harness comprises a single strap configured to be worn by a wearer. In a still further aspect, the strap is extensible over a wearer's shoulder and around a wearer's torso.

In a further aspect, the harness comprises more than two straps configured to be worn by a wearer. For example, a harness can comprise three, four, five, six, or seven straps.

In various aspects, by "extensible around" it is meant that a strap is made to go around, such that the harness is suspended from the shoulder. Each strap can be configured to wrap around all or a portion of a wearer's shoulders, thereby supporting the child along the wearer's back, chest, and/or shoulder area. For example, each strap can be extensible around the wearer's entire shoulder or each strap can be extensible around a portion of the wearer's shoulder. In this way, the wearer's hands remain free and the child's weight does not impede the wearer's upper body mobility.

In a further aspect, each strap has a length of from about 20 inches to about 50 inches. In a still further aspect, each strap has a length of from about 20 inches to about 45 inches. In yet a further aspect, each strap has a length of from about 20 inches to about 40 inches. In an even further aspect, each strap has a length of from about 20 inches to about 35 inches. In a still further aspect, each strap has a length of from about 20 inches to about 30 inches. In yet a further aspect, each strap has a length of from about 20 inches to about 25 inches. In an even further aspect, each strap has a length of from about 25 inches to about 50 inches. In a still further aspect, each strap has a length of from about 30 inches to about 50 inches. In yet a further aspect, each strap has a length of from about 35 inches to about 50 inches. In an even further aspect, each strap has a length of from about 40 inches to about 50 inches. In a still further aspect, each strap has a length of from about 45 inches to about 50 inches.

In a further aspect, the harness further comprises a strap configured to encircle a wearer's waist (i.e., a "waist strap"). Thus, in various aspects, the strap is configured to encircle the wearer's waist and/or hips, thereby supporting the child along the wearer's back, waist, pelvis, and/or buttocks area. In this way, the wearer's hands remain free and the child's weight does not impede the wearer's upper body mobility.

In a further aspect, the waist strap further comprises a closing member. Examples of closing members include, but are not limited to, a buckle, a clasp, a catch, a clip, and hook-and-loop strips.

In a further aspect, the waist strap is connected to the body support member. In a still further aspect, connected is via a seam. In yet a further aspect, connected is via an attachment member. In an even further aspect, the waist strap is reversibly connected to the body support member. In a still further aspect, the waist strap is fixedly connected to the body support member.

In a further aspect, the waist strap is connected to each strap. In a still further aspect, connected is via a seam. In yet a further aspect, connected is via an attachment member. In an even further aspect, the front end and the back end of each strap are joined at about the same point on the waist strap. In a still further aspect, the front end and the back end of each strap are joined at a different point on the waist strap. In yet a further aspect, the waist strap is reversibly connected to each strap. In an even further aspect, the waist strap is fixedly connected to each strap.

In a further aspect, the waist strap has a length of from about 15 inches to about 57 inches. In a still further aspect, the waist strap has a length of from about 15 inches to about 55 inches. In yet a further aspect, the waist strap has a length of from about 15 inches to about 50 inches. In an even further aspect, the waist strap has a length of from about 15 inches to about 45 inches. In a still further aspect, the waist strap has a length of from about 15 inches to about 40 inches. In yet a further aspect, the waist strap has a length of from about 15 inches to about 35 inches. In an even further aspect, the waist strap has a length of from about 15 inches to about 30 inches. In a still further aspect, the waist strap has a length of from about 15 inches to about 25 inches. In yet a further aspect, the waist strap has a length of from about 15 inches to about 20 inches. In an even further aspect, the waist strap has a length of from about 20 inches to about 57 inches. In a still further aspect, the waist strap has a length of from about 25 inches to about 57 inches. In yet a further aspect, the waist strap has a length of from about 30 inches to about 57 inches. In an even further aspect, the waist strap has a length of from about 35 inches to about 57 inches. In a still further aspect, the waist strap has a length of from about 40 inches to about 57 inches. In yet a further aspect, the waist strap has a length of from about 45 inches to about 57 inches. In an even further aspect, the waist strap has a length of from about 50 inches to about 57 inches.

In a further aspect, the harness further comprises a strap connector slidably coupled to the pair of straps, thereby establishing an intersection point, and wherein the strap connector is slidable along the pair of straps to move the intersection point along the pair of straps.

C. Methods of Making a Carrier

In one aspect, disclosed are methods of making a carrier, the method comprising attaching a compartment dimensioned to support a child and a harness dimensioned to fit a wearer, wherein the wearer can reposition the carrier to selectively support the child facing towards or away from the wearer without removing the child from the compartment. In a further aspect, attaching is fixedly attaching.

In a further aspect, attaching is via a seam. In a still further aspect, attaching is via engagement of at least one pair of attachment members.

In a further aspect, the compartment comprises: (a) a head support member dimensioned to support a child's head, wherein the head support has a top edge; (b) a first body support member dimensioned to support a child's back, wherein the first body support member has a bottom edge and a pair of side edges, and wherein the first support member is connected to the head support member; and (c) a second body support member dimensioned to support a child's front, wherein the second body support member has a length, a top edge, a bottom edge, and a pair of side edges, and wherein the second body support member is connected to the first body support member, wherein the first body support member and the second body support member together comprise a seat support member.

In a further aspect, the compartment comprises: (a) a head support member dimensioned to support a child's head, wherein the head support has a top edge; (b) a first body support member dimensioned to support a child's back, wherein the first body support member has a bottom edge and a pair of side edges, and wherein the first support member is connected to the head support member; and (c) a second body support member dimensioned to support a child's front, wherein the second body support member has a length, a top edge, a bottom edge, and a pair of side edges, and wherein the second body support member is connected to the first body support member, wherein the first body support member and the second body support member together comprise a seat support member, and wherein the head support member and first body support member together have a length that is longer than the length of the second body support member.

In a further aspect, the harness comprises a pair of straps configured to be worn by the wearer, and wherein each strap has a first end and a second end.

In a further aspect, the harness comprises a single strap configured to be worn by a wearer. In a still further aspect, the strap is extensible over a wearer's shoulder and around a wearer's torso.

In a further aspect, the harness comprises more than two straps configured to be worn by a wearer. For example, a harness can comprise three, four, five, six, or seven straps.

In a further aspect, the harness further comprises a strap configured to encircle a wearer's waist (e.g., a "waist strap"). Thus, in various aspects, the strap is configured to encircle the wearer's waist and/or hips, thereby supporting the child along the wearer's back, waist, pelvis, and/or buttocks area. In this way, the wearer's hands remain free and the child's weight does not impede the wearer's upper body mobility.

D. Methods of Repositioning a Child

In one aspect, disclosed are methods of repositioning a child in a carrier, the method comprising: (a) removing a carrier with a child in a rear facing position from a first wearer, wherein the carrier comprises a compartment dimensioned to support a child and a harness dimensioned to fit a wearer, wherein the harness is attached to the compartment; and (b) putting the carrier on a second wearer, wherein the child is in a forward facing position, without removing the child from the carrier.

In one aspect, disclosed are methods of repositioning a child in a carrier, the method comprising: (a) removing a carrier with a child in a forward facing position from a first wearer, wherein the carrier comprises a compartment dimensioned to support a child and a harness dimensioned to fit a wearer, wherein the harness is attached to the compartment; and (b) putting the carrier on a second wearer, wherein the child is in a rear facing position, without removing the child from the carrier.

In one aspect, disclosed are methods of repositioning a child in a carrier, the method comprising: (a) detaching a compartment with a child in a forward facing position from a harness on a first wearer; and (b) attaching the compartment to the harness on a second wearer, wherein the child is in a rear facing position, without removing the child from the compartment.

In one aspect, disclosed are methods of repositioning a child in a carrier, the method comprising: (a) detaching a compartment with a child in a rear facing position from a harness on a first wearer; and (b) attaching the compartment to the harness on a second wearer, wherein the child is in a forward facing position, without removing the child from the compartment.

In a further aspect, the first and second wearer is the same person.

In a further aspect, the carrier is on the first wearer's back. In a still further aspect, the carrier is on the first wearer's torso. In yet a further aspect, the carrier is on the second wearer's back. In an even further aspect, the carrier is on the second wearer's torso.

In a further aspect, attached is via a seam. In a still further aspect, attached is via attachment members. In yet a further aspect, attached is fixedly attached. In an even further aspect, attached is reversibly attached.

E. Kits

In one aspect, disclosed are kits comprising a carrier comprising a compartment dimensioned to support a child, wherein the compartment is configured to reversibly attach to a harness dimensioned to fit a wearer, and one or more of: (a) a harness dimensioned to fit a wearer; (b) instructions for attaching the carrier and the harness; (c) instructions for wearing the harness; and (d) instructions for repositioning a child.

In one aspect, disclosed are kits comprising carriers comprising a compartment dimensioned to support a child, wherein the compartment comprises: (i) a head support member dimensioned to support a child's head, wherein the head support has a top edge; (ii) a first body support member dimensioned to support a child's back, wherein the first body support member has a bottom edge and a pair of side edges, and wherein the first support member is connected to the head support member; and (iii) a second body support member dimensioned to support a child's front, wherein the second body support member has a length, a top edge, a bottom edge, and a pair of side edges, and wherein the second body support member is connected to the first body support member, wherein the first body support member and the second body support member together comprise a seat support member, and wherein the head support member and first body support member together have a length that is longer than the length of the second body support member, wherein the compartment is configured to reversibly attach to a harness dimensioned to fit a wearer, and one or more of: (a) a harness dimensioned to fit a wearer; (b) instructions for attaching the carrier and the harness; (c) instructions for wearing the harness; and (d) instructions for repositioning a child.

In one aspect, disclosed are kits comprising carriers comprising a compartment dimensioned to support a child, wherein the compartment comprises: (i) a head support member dimensioned to support a child's head, wherein the head support has a top edge; (ii) a first body support member dimensioned to support a child's back, wherein the first body support member has a bottom edge and a pair of side edges, and wherein the first support member is connected to the head support member; and (iii) a second body support member dimensioned to support a child's front, wherein the second body support member has a length, a top edge, a bottom edge, and a pair of side edges, and wherein the second body support member is connected to the first body support member, wherein the first body support member and the second body support member together comprise a seat support member, wherein the carrier is configured to reversibly attach to a harness dimensioned to fit a wearer, and one or more of: (a) a harness dimensioned to fit a wearer; (b) instructions for attaching the carrier and the harness; (c) instructions for wearing the harness; and (d) instructions for repositioning a child.

It will be apparent to those skilled in the art that various modifications and variations can be made in the present invention without departing from the scope or spirit of the invention. Other aspects of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A carrier comprising:

(a) a compartment dimensioned to support a child, wherein the compartment comprises:

(i) a head support member dimensioned to support a child's head, wherein the head support has a top edge;

(ii) a first body support member dimensioned to support a child's back, wherein the first body support member has a bottom edge and a pair of side edges, and wherein the first support member is connected to the head support member; and (iii) a second body support member dimensioned to support a child's front, wherein the second body support member has a length, a top edge, a bottom edge, a pair of side edges, and a first pair of attachment members, and wherein the second body support member is connected to the first body support member, wherein the first body support member and the second body support member together comprise a seat support member, and wherein the head support member and the first body support member together have a length that is longer than the length of the second body support member; and (b) a harness dimensioned to fit a wearer, wherein the harness comprises a pair of shoulder straps configured to be worn over the wearer's shoulders during use, wherein each shoulder strap has a first end and a second end, wherein each first end is fixedly attached solely to the head support member and wherein each second end comprises an attachment member that is configured for engagement with one of the attachment members in the first pair of attachment members on the second body support member, wherein the carrier is configured such that the wearer can reposition the carrier to selectively support the child facing towards the wearer or away from the wearer, when the harness is on the wearer, without removing the child from the compartment.

2. The carrier of claim 1, wherein the seat support comprises two openings dimensioned to allow a child's leg to be insertable through each opening.

3. The carrier of claim 1, wherein the first body support member comprises a first pair of attachment members, wherein the second body support member comprises a second pair of attachment members, and wherein the first pair of attachment members on the first body support member are configured for engagement with the second pair of attachment members on the second body support member.

4. The carrier of claim 3, wherein the first body support member comprises a second pair of attachment members, wherein the second body support member comprises a third pair of attachment members, and wherein the second pair of attachment members on the first body support member are configured for engagement with the third pair of attachment members on the second body support member.

5. The carrier of claim 1, wherein each first end is connected to the compartment via a seam.

6. The carrier of claim 1, wherein each first end is fixedly attached solely to the top edge of the head support member.

7. The carrier of claim 1, wherein each shoulder strap has a length of from about 20 inches to about 50 inches.

8. The carrier of claim 1, wherein each shoulder strap has a length of from about 20 inches to about 40 inches.

9. The carrier of claim 1, further comprising a waist strap.

10. The carrier of claim 9, wherein the waist strap is connected to the first body support member.

11. The carrier of claim 10, wherein the waist strap is fixedly connected to the first body support member.

12. The carrier of claim 10, wherein the waist strap is connected to the first body support member via a seam.

13. A carrier comprising:

(a) a compartment dimensioned to support a child, wherein the compartment comprises:

(i) a head support member dimensioned to support a child's head, wherein the head support has a top edge;

(ii) a first body support member dimensioned to support a child's back, wherein the first body support member has a bottom edge, a pair of side edges, and a first pair of attachment members, and wherein the first support member is connected to the head support member; and (iii) a second body support member dimensioned to support a child's front, wherein the second body support member has a length, a top edge, a bottom edge, a pair of side edges, and a first pair of attachment members, and wherein the second body support member is connected to the first body support member, wherein the first body support member and the second body support member together comprise a seat support member, and wherein the head support member and first body support member together have a length that is longer than the length of the second body support member;

(b) a harness dimensioned to fit a wearer, wherein the harness comprises a pair of shoulder straps, wherein each shoulder strap has a first end and a second end, wherein each first end is fixedly attached solely to the head support member, and wherein each second end comprises an attachment member configured for engagement with one of the attachment members in the first pair of attachment members on the second body support member; and (c) a waist strap.

14. The carrier of claim 13, wherein each first end is fixedly attached solely to the top edge of the head support member.

15. The carrier of claim 13, wherein each shoulder strap has a length of from about 20 inches to about 40 inches.

16. The carrier of claim 13, wherein the waist strap is fixedly connected to the first body support member.

17. A carrier comprising:

(a) a compartment dimensioned to support a child, wherein the compartment comprises:

(i) a head support member dimensioned to support a child's head, wherein the head support has a top edge;

(ii) a first body support member dimensioned to support a child's back, wherein the first body support member has a bottom edge and a pair of side edges, and wherein the first support member is connected to the head support member; and (iii) a second body support member dimensioned to support a child's front, wherein the second body support member has a length, a top edge, a bottom edge, a pair of side edges, and a first pair of attachment members, and wherein the second body support member is connected to the first body support member, wherein the first body support member and the second body support member together comprise a seat support member, and wherein the head support member and the first body support member together have a length that is longer than the length of the second body support member; and (b) a harness dimensioned to fit a wearer, wherein the harness comprises a pair of shoulder straps configured to be worn over the wearer's shoulders during use, wherein each shoulder strap has a first end and a second end, wherein each first end is fixedly attached solely to the head support member and wherein each second end comprises an attachment member that is configured for engagement with one of the attachment members in the first pair of attachment members on the second body support member, wherein the carrier is configured such that the wearer can reposition the carrier to selectively support the child facing towards the wearer or away from the wearer, when the harness is on the wearer, without removing the child from the compartment.

18. The carrier of claim 17, wherein each first end is attached directly to the top edge of the head support member.

19. The carrier of claim 17, wherein the seat support comprises two openings dimensioned to allow a child's leg to be insertable through each opening.

20. The carrier of claim 17, wherein each shoulder strap has a length of from about 20 inches to about 40 inches.

21. The carrier of claim 17, further comprising a waist strap.

* * * * *